US010814345B2

(12) United States Patent
Hidaka

(10) Patent No.: US 10,814,345 B2
(45) Date of Patent: Oct. 27, 2020

(54) SUCK-BACK TYPE COATING GUN UNIT

(71) Applicant: Sun Tool Corporation, Moriguchi-shi, Osaka (JP)

(72) Inventor: Shoji Hidaka, Moriguchi (JP)

(73) Assignee: Sun Tool Corporation, Moriguchi-shi (JP)

( * ) Notice: Subject to any disclaimer, the term of this patent is extended or adjusted under 35 U.S.C. 154(b) by 0 days.

(21) Appl. No.: 16/325,545

(22) PCT Filed: Jul. 10, 2017

(86) PCT No.: PCT/JP2017/026377
§ 371 (c)(1),
(2) Date: Feb. 14, 2019

(87) PCT Pub. No.: WO2018/034102
PCT Pub. Date: Feb. 22, 2018

(65) Prior Publication Data

US 2019/0210058 A1 Jul. 11, 2019

(30) Foreign Application Priority Data

Aug. 16, 2016 (JP) ..... 2016-172278

(51) Int. Cl.
*B05C 11/10* (2006.01)
*B05C 17/005* (2006.01)
(Continued)

(52) U.S. Cl.
CPC ..... *B05C 11/1039* (2013.01); *B05C 5/00* (2013.01); *B05C 5/0258* (2013.01);
(Continued)

(58) Field of Classification Search
None
See application file for complete search history.

(56) References Cited

U.S. PATENT DOCUMENTS 4,535,802 A * 8/1985 Robertson ..... F16K 31/52408 137/322
4,582,231 A * 4/1986 Warning, Jr. ..... B05C 5/0275 222/485

FOREIGN PATENT DOCUMENTS

EP 1882525 A2 1/2008
JP 48-009458 B 3/1973
(Continued)

OTHER PUBLICATIONS

International Search Report dated Oct. 3, 2017 issued for PCT/JP2017/026377.

*Primary Examiner* — Jethro M. Pence
(74) *Attorney, Agent, or Firm* — Norton Rose Fulbright US LLP

(57) ABSTRACT

A suck-back type coating gun unit characterized in that a needle, which is formed into a single body with a movable valve body of a valve mechanism, is provided, and a cam-type valve driving mechanism, which includes a cam that is at its cam surface in contact with the tip end of the needle, is provided. In this suck-back type coating gun unit, a cam-type valve driving mechanism that makes stroke motions is configured in which the rotational operation of the cam body is converted into a stroke operation to make a valve ON and OFF operation of the hot melt coating gun unit, so that the ON operation is made by the ridge portion of the cam body and the OFF operation is made by the valley portion of the cam body.

10 Claims, 5 Drawing Sheets

(51) Int. Cl.
*B05C 5/02* (2006.01)
*B05C 5/00* (2006.01)

(52) U.S. Cl.
CPC .... *B05C 11/1034* (2013.01); *B05C 17/00503* (2013.01); *B05C 5/0275* (2013.01)

(56) References Cited

FOREIGN PATENT DOCUMENTS

| | | | |
|---|---|---|---|
| JP | 51-043245 | Y | 10/1976 |
| JP | 10-192763 | A | 7/1998 |
| JP | 2000-033315 | A | 2/2000 |
| JP | 2006-051407 | A | 2/2006 |
| JP | 2012-047245 | A | 3/2012 |
| JP | 2013-4122527 | A | 2/2013 |
| JP | 2016-185504 | A | 10/2016 |

* cited by examiner

SUCK-BACK TYPE COATING GUN UNIT

CROSS REFERENCES TO RELATED APPLICATIONS

This application is a national stage application pursuant to 35 U.S.C. § 371 of International Application No. PCT/W20171026377, filed on Jul. 10, 2017, which claims priority under 35 U.S.C. § 119 to Japanese Patent Application No. 2016-172278, filed on Aug. 16, 2016, the disclosures of which are hereby incorporated by reference in their entireties

TECHNICAL FIELD

The present invention relates to a coating gun unit for performing an intermittent coating of a liquid adhesive (such as a hot-melt adhesive) onto the surface of a film substrate. More specifically, the present invention relates to a valve mechanism of a coating gun unit for intermittently supplying a hot-melt adhesive.

In this valve mechanism, material (liquid adhesive) is applied to a substrate when the valve is in the open position and, after a certain amount of time passes, the valve is moved to its closed position so that the application of the material is stopped. This cycle is repeated with a fixed interval. In an intermittent coating, the interval is often made extremely short so that coated regions are formed sequentially with small intervals. In many applications, it is demanded that the flow of the material be stopped 1000 times per minute. It is also demanded that for coating patterns produced on a substrate, each of the regions where the material is applied on the substrate has sharp boundary lines.

It may, however, not be possible to promptly stop the application of material to a substrate with a speed needed to form a sharp boundary line at the final edge of the application region. In other words, since it is not possible, when closing the valve, to avoid "dripping" of the material from the adhesive hole of a coating gun unit, there is a problem that the phenomena of "rippling" and "stringing" would occur.

PRIOR ART DOCUMENTS

Patent Documents

[Patent Document 1] Japanese Patent Application Laid-Open (Kokai) H10-192763

SUMMARY OF THE INVENTION

Problem the Invention is to Solve

The invention of Patent Document 1 is a means for solving the problem of prior art described above. The invention disclosed in the Patent Document 1 eliminates the phenomena of "rippling" and "stringing" by using the suck-back effect.

More specifically, the invention of the Patent Document 1 is structured so that it includes a valve mechanism, which comprises a movable valve body and a valve seat, and a movable valve body driving mechanism, which controls an air supply by an electromagnetic valve, and so that it generates, when the valve body is raised, a suction action for the hot-melt adhesive between the expanded portion at the bottom portion of the movable valve body and the valve, thus producing a suck back effect for the hot-melt adhesive when the state of the valve changes from the open state shown in FIG. 10 to the closed state shown in FIG. 9.

Since in the above-described structure the movable valve body driving mechanism includes an electromagnetic valve, it has the problem that the intermittent timing of the coating of the hot-melt adhesive is limited by the response time of the electromagnetic valve.

The object of the present invention is to make it possible to set the timing of a valve operation to be in an extremely short interval that is not limited by a response time that exceeds the limitations of an electromagnetic valve during intermittent coating of hot-melt adhesives.

Means for Solving the Problem

The present invention provides a suck-back type coating gun unit that includes a valve mechanism which is structured such that an expanded portion at the bottom portion of a movable valve body and a valve seat generate a suction action for a hot-melt adhesive when the valve body is raised, and the coating gun unit is characterized in that:

a needle, which is formed as a single body with the movable valve body of the valve mechanism, is provided, and a cam-type valve driving mechanism, which includes a cam that is at its cam surface in contact with the tip end of the needle, is provided; and the coating timing of the hot-melt adhesive is controlled by the rotation of the cam.

Effect of the Invention

The present invention, without the use of an electromagnetic valve as a driving means for the movable valve body, makes it possible to provide a response time that exceeds the limitation of the electromagnetic valve during intermittent coating of a hot-melt adhesive.

Therefore, according to the present invention, it is possible to achieve a response time that exceeds the limitation of the electromagnetic valve, and the timing of the valve operation can be set to be an extremely short interval for intermittent coating.

EMBODIMENTS TO CARRY OUT THE INVENTION

Figure 1:
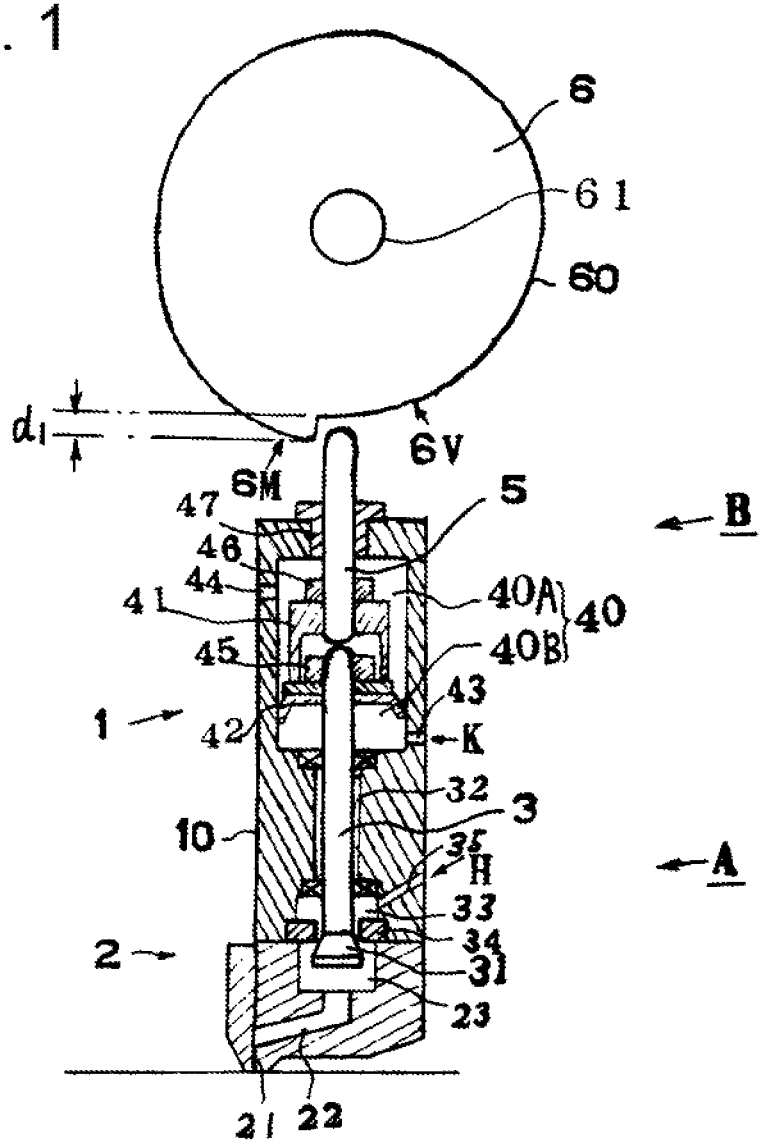
FIG. 1 A vertical cross-sectional view of the suck-back type coating gun unit according to a first embodiment of the present invention in an OFF operating state.

A suck-back type coating gun unit according to the present invention will be described below with reference to FIG. 1 in which the valve operation is OFF and FIG. 2 in which the valve operation is ON.

The gun unit is configured by continuously connecting a coater head 2 to the trip encs of a gun module 1.

The gun module 1 is comprised of a valve mechanism A, which includes a movable valve body 3, and a cam-type valve driving mechanism (a valve body driving mechanism) B, which is for raising and lowering the movable valve body 3, forming into a single body. The reference symbol H indicates a supply of a hot melt, and K indicates a supply of operation air.

The hot-melt adhesive H is consistently supplied into a valve chamber 33 of the valve mechanism A.

The coater head 2 has an adhesive hole 21, an adhesive supply path 22, and an adhesive chamber 23.

The valve mechanism A is structured so that the movable valve body 3 that has an expanded portion 31 formed at its bottom portion is supported in a freely movable fashion in the vertical direction by a bearing 32 which is provided in the housing 10.

The valve chamber 33 is provided at the inside bottom of the housing 10, and a valve seat 34 is formed on the lower surface of the valve chamber 33. An adhesive inlet 35 that communicates with the valve chamber 33 is formed in the side wall of the housing 10.

As seen from the above, the valve mechanism A that performs the opening and closing operations of the movable valve body 3 is configured between the valve seat 34 and the expanded portion 31 of the valve body 3.

The valve body driving mechanism B is provided in the upper portion of the housing 10 and is formed with a space 40 in which a movable body 41 is installed. A partition 42 is attached to the lower surface of the movable body 41, thus dividing the space 40 into two parts, namely, an upper space 40A and a lower space 40B.

On the side wall of the housing 10, there are provided an air hole 44 that communicates with the upper space 40A and an air hole 43 that communicate with the lower space 40B, so that when the movable body 41 is moved up and down, air is expelled out from and drawn in through the air holes 44 and 43 according to the changes in volume of the upper space 40A and the lower space 40B.

A cap 47 that has a longitudinal hole is fitted in the top wall of the housing 10, thus closing the space 40 of the housing 10.

Next, a needle 5 will be described.

The upper end of the movable valve body 3 is fixed to the lower part of the movable body 41 by a fastening device (a nut) 45, and a needle 5 is attached, at its the lower end, to the upper part of the movable body 41 by a fastening device (a nut) 46, so that the movable valve body 3 and the needle 5 form a single body via the movable body 41.

The upper portion of the needle 5 is brought through the longitudinal hole of the cap 47, so that the upper portion is supported by the top wall of the housing 10 in such a manner that the needle 5 is movable up and down.

A cam body 6 that moves the needle 5 up and down will be described next.

The cam body 6 is a circular disk that is supported rotatably on a driving rotational axle 61, and it has a cam surface 60 on its peripheral surface. The cam body 6 is provided vertically, and the cam surface 60 is in contact with the tip end of the needle 5.

The cam surface 60 is formed with a ridge portion 6M and a valley portion 6V. With the needle 5 being in contact at its tip end with the ridge and valley portions 6M and 6V, the needle being urged upward by the air in the space 40 is raised and lowered when the cam body 6 rotates, thus making a stroke (straight) motion.

Figure 2:
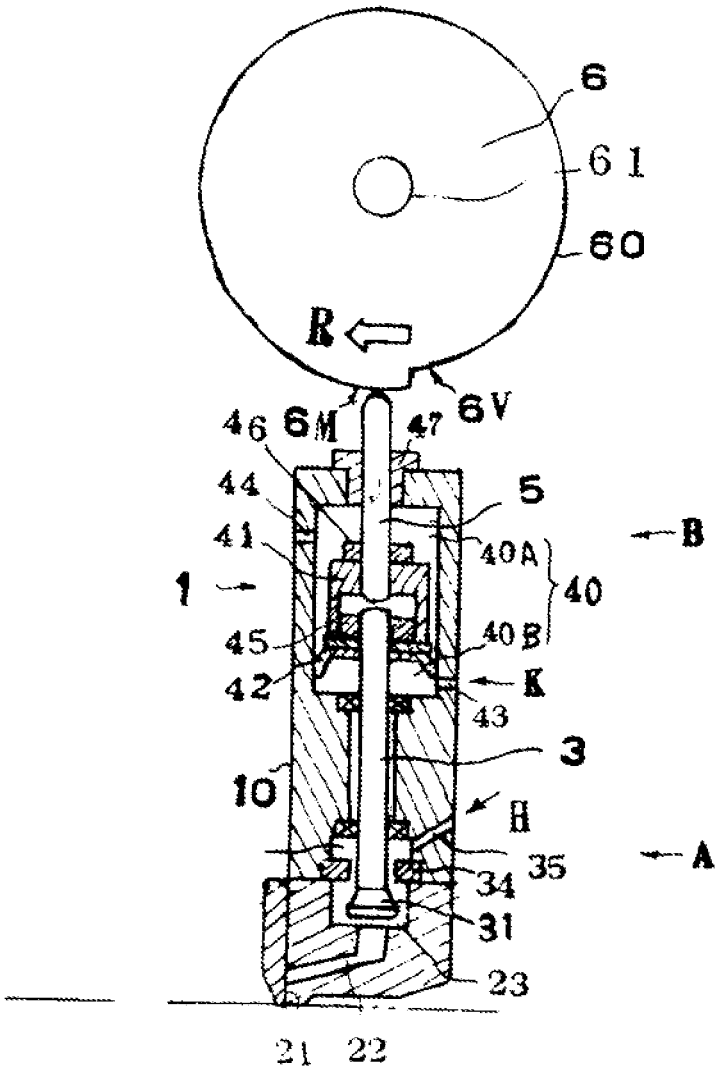
FIG. 2 A vertical cross-sectional view of an ON operating state thereof.

In the embodiments of FIG. 1 and FIG. 2, one pair of ridge and valley portions 6M and 6V are formed on the cam surface 60, so that when the cam body 6 makes one rotation, the needle 5 makes one stroke of up and down motion. The reference symbol "$d_1$" represents the length for the up and down motion of the needle. The reference number "61" is the rotational axle for the cam body.

Figure 4A:
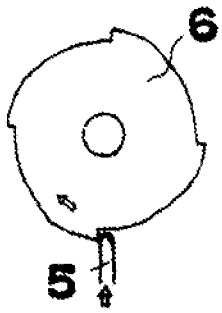
FIG. 4 An illustration describing the operation of a cam of the cam-type valve mechanism of the present invention, in which the cam is divided into four parts for one rotation, with FIG. 4*a* showing the OFF operation where the needle is at the raised position, FIG. 4*b* showing the ON operation where the needle is moving downward, and FIG. 4*c* showing the ON operation where the needle is at the lowered position.
Figure 4B:
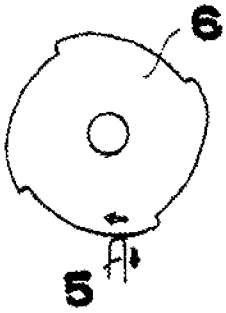
Figure 4C:
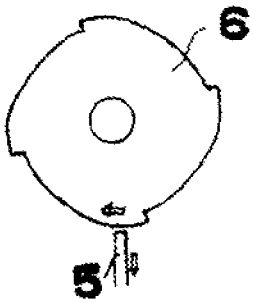

In the embodiments of FIG. 4 and FIG. 4 that will be described below, the cam surface 60 is divided into parts of 360/N, forming a plurality of pairs of ridge and valley portions 6M and 6V (or the cam body is divided into N parts). With N number of ridge and valley portions 6M and 6V, a plurality of number (N) of up and down stroke motions of the needle 5 is obtained per one rotation of the cam body 6.

Figure 3:
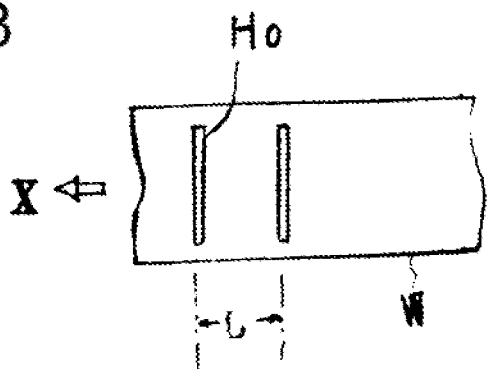
FIG. 3 A top view of an example of a coating pattern on a substrate.

The hot-melt adhesive H is consistently supplied into the valve chamber 33 of the valve mechanism A; and with the valve operations of the valve mechanism, the hot-melt adhesive H is intermittently coated onto a substrate W. With reference to FIG. 3, at the timing of valve ON operation, the expanded portion 31 of the valve body 3 is raised to open the valve, and the hot-melt adhesive H in the valve chamber 33 is applied onto the substrate W which is being transferred in its moving direction X. As a result, hot-melt adhesive coated surfaces $H_0$ are intermittently formed on the surface of the substrate W being transferred.

In the embodiments of FIG. 1 and FIG. 2, as to the air hole 43 for the lower space 40B, air K is supplied to the air hole 43 in order to supply air into the lower space 40B; as a result, the space 40 serves as a cylinder chamber, and the movable body 41 is raised, thus providing the movable body 41 with an upward force constantly, forming an urging means added to the movable body 41.

Figure 8:
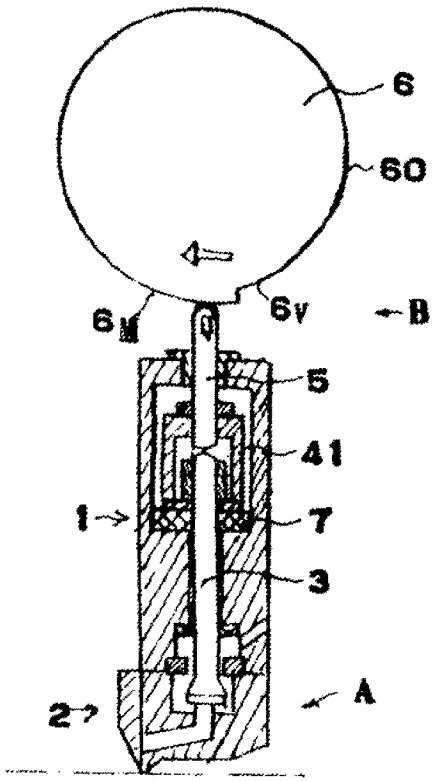
FIG. 8 A vertical cross-sectional view showing an ON operating state according to the second embodiment of the present invention.
Figure 7:
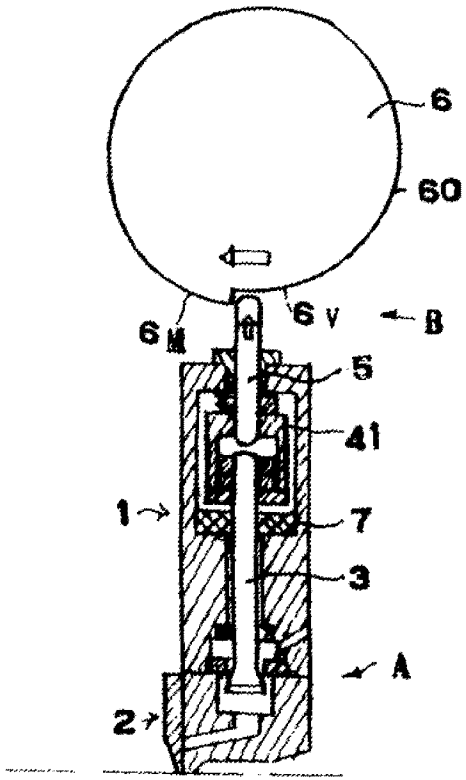
FIG. 7 A vertical cross-sectional view of the suck-back type coating gun unit according to a second embodiment of the present invention in an OFF operating state.

In the embodiments shown in FIG. 7 and FIG. 8, a magnet (permanent magnet) 7 is provided at an appropriate location in the space 40. The magnet (permanent magnet) 7 generates a magnetic force that serves to raise the needle 5 as an urging means for constantly urging the needle 5 in the upward direction, thus being an replacement with the air K of FIG. 1 and FIG. 2 which is supplied through the air hole 43 into the lower space 40B.

Instead of the magnet (permanent magnet) 7, it is also possible to provide a piezoelectric element, so that the action of the piezoelectric actuator serves as an urging means for constantly urging the needle 5 in the upward direction.

As to the operation of the cam body 6, FIG. 4 shows a case in which the cam body is divided into four equal parts so that the needle 5 (the movable valve body 3) makes four strokes as the cam body makes one rotation.

Figure 5A:
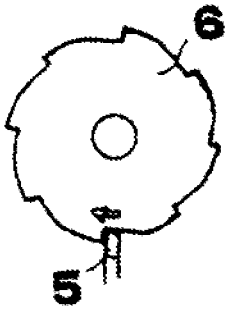
FIG. 5 An illustration describing the operation of a cam of the cam-type valve mechanism of the present invention, in which the cam is divided into eight parts for one rotation, likewise in FIG. 4, with FIG. 5*a* showing the OFF operation where the needle is at the raised position, FIG. 5*b* showing the ON operation where the needle is moving downward, and FIG. 5*c* showing the ON operation where the needle is at the lowered position.
Figure 5B:
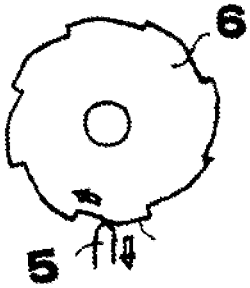
Figure 5C:
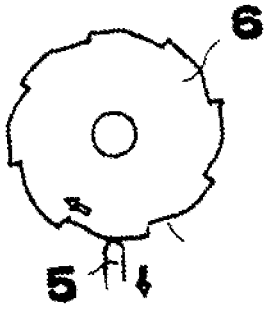

FIG. 5 shows a cam body divided into eight equal parts so that the needle (the movable valve body) makes eight strokes per one rotation of the cam body.

Figure 6:
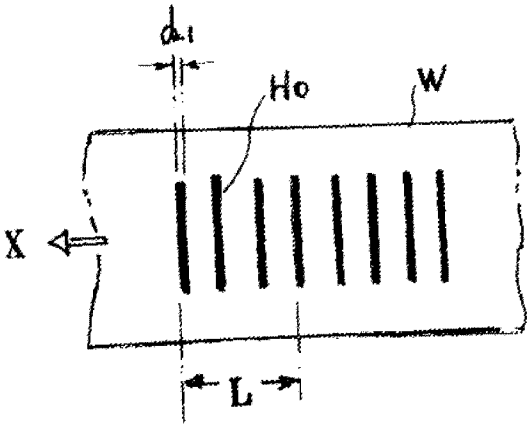
FIG. 6 A top view showing another coating pattern on a substrate made by the cam-type valve mechanism of the present invention that uses a cam divided into four parts for one rotation.
Figure 10:
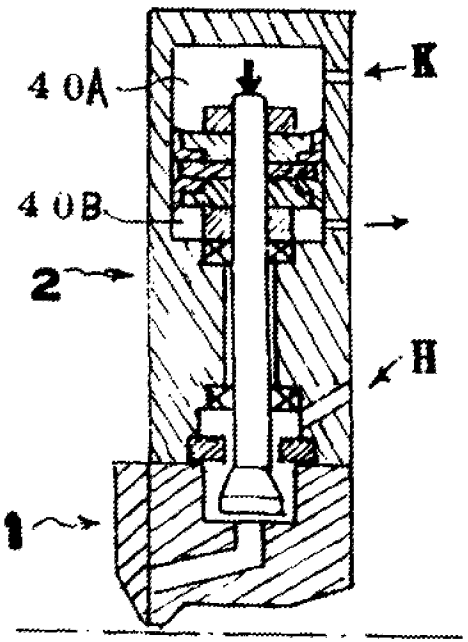
FIG. 10 Prior Art
FIG. 10 A vertical cross-sectional view of the prior art suck-back type coating gun unit in its ON operating state.
Figure 9:
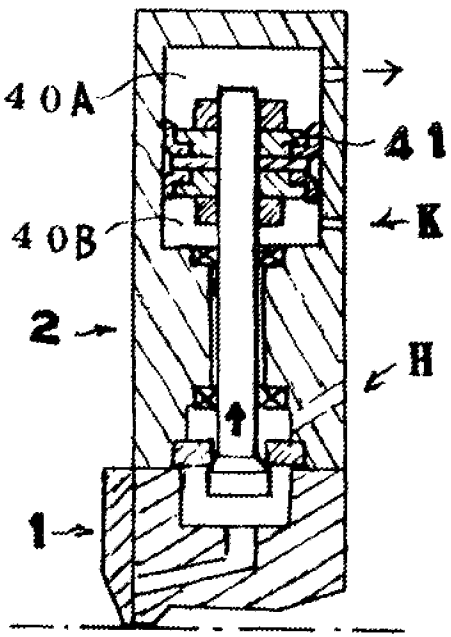
FIG. 9 Prior Art
FIG. 9 A vertical cross-sectional view of a prior art suck-back type coating gun unit in its OFF operating state.

FIG. 6 shows a manner of coating of a liquid adhesive (such as a hot-melt adhesive) according to the embodiments under the following conditions:

Needle stroke $d_1$ $d_1$=0.4 mm

Cam body Divided into four parts

Cam rotation 400 rpm

ON/OFF operation of servo motor 30 ms

Response frequency 2000/minute

Coating length $d_2$=2.5 mm

Coating pause length 7.0 mm

Cam surface length L in one rotation of cam L=40 mm

Here the characteristics of the present invention are listed:

The driving of the rotation of the cam is variable in speed via a servo motor, so that the coating length can be electrically controlled.

A response time that exceeds the limitations of the electromagnetic valve is achieved.

The rotation of the cam and the stroke operation of the valve body operate simultaneously by a linear motion.

The cam is a circular disk with arbitrary number of ridges and valleys in the direction of cam rotation to determine the coating length.

The rotational driving of the cam is variable by a servo motor, so that the coating length can be electrically controlled.

The rotation of the servo motor can be synchronized with that of a parent machine that moves the substrate so as to set coating positions.

The rotation of the servo motor can be used for the ON/OFF operation within a range of 0 to 3000 times per minute so as to correspond to the substrate moving speed in the high-speed hot-melt adhesive application line.

It is not a stroke operation by an electromagnetic valve and air, but rather it is a linear direct motion, accordingly there is no operation loss time.

Parts to connect the electromagnetic valve are not needed.

Time and expenses for replacement operations due to the response lifetime of the electromagnetic valve are unnecessary.

The 360 degrees of the cam's one rotation can be divided into four parts, making it possible to increase the ON/OFF range.

Driving with an electromagnetic valve and air would limit the strokes to 1400 per minute; however, the rotational driving by a servo motor makes it possible for the strokes to be 3000 per minute.

INDUSTRIAL APPLICABILITY

The present invention contributes to industrial development by, when performing an intermittent coating of a hot-melt adhesive, decreasing the manufacturing cost since it can shorten the coating timing and thus make it possible to further speed-up the coating production line.

EXPLANATION OF SYMBOLS

1 Gun module
2 Coater head
3 Movable valve body
5 Needle
6 Cam body
A Valve mechanism
B Cam-type valve driving mechanism (Cam body driving mechanism)

The invention claimed is:

1. A coating gun unit comprising a valve mechanism that includes a valve seat and an expanded portion at a bottom portion of a movable valve body, the valve mechanism configured to generate a suction action of a hot-melt adhesive when the movable valve body is raised, said coating gun unit being characterized in that:

the coating gun unit further includes a needle coupled to the movable valve body of the valve mechanism and includes a cam valve driving mechanism, the cam valve driving mechanism including a cam body comprising a cam surface in contact with a tip end of the needle, and a coating timing is configured to be set by a rotation of the cam.

2. A coating gun unit comprising a valve mechanism that includes a valve seat and an expanded portion at a bottom portion of a movable valve body, the valve mechanism configured to generate a suction action of a hot-melt adhesive when the movable valve body is raised, said coating gun unit being characterized in that:

the coating gun unit further includes a needle coupled to the movable valve body of the valve mechanism and includes a cam body comprising a cam surface in contact with a tip end of the needle, and a cam valve driving mechanism is configured to make an ON and OFF operation of the coating gun unit by converting a rotational operation of the cam body into a stroke operation, so that the ON operation is made by a ridge portion of the cam body and the OFF operation is made by a valley portion of the cam body.

3. The coating gun unit according to claim 2, wherein:

the cam body of said cam valve driving mechanism is provided with a plurality of ridge portions and valley portions; and one rotation of the cam causes multiple valve operations.

4. An apparatus comprising:

a coating gun configured to provide a flowable material for a duration and generate a suction force at a valve seat, the coating gun including:

the valve seat;

a movable valve body including a first end and including a second end opposite the first end, the second end including an expanded portion configured to couple to the valve seat;

a needle including a third end and including a fourth end opposite the third end, the fourth end coupled to the first end of movable valve body; and a cam body including a cam surface in contact with the third end of the needle, wherein a rotation of the cam body corresponds to the duration.

5. The apparatus according to claim 4, wherein:

the movable valve body is configurable into a first position and a second position;

the first position corresponds with the expanded portion of the second end in contact with the valve seat such that a seal is formed;

the second position corresponds with the expanded portion of the second end positioned such that the expanded portion and the valve seat define a space interposed between the expanded portion and the valve seat; and the coating gun is configured to generate the suction force between the expanded portion and the valve seat while the movable valve body moves from the second position to the first position.

6. The apparatus according to claim 5, further comprising:

a housing defining a cavity and including the movable valve body and the needle;

a partition configured to divide the cavity into a first side and a second side, the first side interposed between the cam body and the partition and the second side interposed between the expanded portion and the partition; and wherein:

the housing defines a first air hole on the first side, the first side of the cavity configured to be in fluid communication with outside air via the first air hole; and the housing defines a second air hole on the second side, the second side of the cavity configured to receive an air supply via the second air hole such that the expanded portion is biased toward the valve seat.

7. The apparatus according to claim 5, further comprising:

a housing defining a cavity and including the movable valve body and the needle; and a magnet positioned within the cavity and configured to bias the expanded portion toward the valve seat.

8. The apparatus according to claim 5, wherein:

the cam body is configured to move the expanded portion from the first position to the second position via the needle.

9. The apparatus according to claim 8, wherein:

one rotation of the cam body is configured to move the expanded portion from the first position to the second position multiple times.

10. The apparatus according to claim 5, wherein:

the coater gun is configured to provide the flowable material via the valve seat based on the expanded portion being in the second position; and the coater gun is configured to stop providing the flowable material based on the expanded portion being in the first position.

* * * * *